US007389714B1

(12) United States Patent
Heagerty

(10) Patent No.: US 7,389,714 B1
(45) Date of Patent: Jun. 24, 2008

(54) DUAL ACTION LOCKING PLIERS

(76) Inventor: Michael Heagerty, 19861 Hollygrape St., Bend, OR (US) 97701

( * ) Notice: Subject to any disclaimer, the term of this patent is extended or adjusted under 35 U.S.C. 154(b) by 0 days.

(21) Appl. No.: 11/219,112

(22) Filed: Oct. 24, 2005

(51) Int. Cl.
*B25B 7/12* (2006.01)

(52) U.S. Cl. ..... 81/367; 81/370

(58) Field of Classification Search ..... 81/367–383, 81/383.5

See application file for complete search history.

(56) References Cited

U.S. PATENT DOCUMENTS 2,327,368 A * 8/1943 Olson ..... 81/374
2,838,973 A * 6/1958 Petersen ..... 81/370
3,354,759 A * 11/1967 Cook ..... 81/379
5,056,385 A * 10/1991 Petersen ..... 81/370
5,460,065 A * 10/1995 Balmer ..... 81/368
6,012,361 A * 1/2000 Wooster et al. ..... 81/367
6,626,070 B2 * 9/2003 Peperkorn et al. ..... 81/370

* cited by examiner

*Primary Examiner*—D. S. Meislin
(74) *Attorney, Agent, or Firm*—Glenn C. Brown

(57) ABSTRACT

A locking pliers tool with an improved dual action driver handle comprising two intersecting handles and interacting jaws. When the user grips the handle forward the resultant force produces a locking action. Conversely, when a rearward gripping force is initiated, the tool releases its grip on the object. A limited amount of energy on the inventive handle produces free movement of the handle and gripping mechanism to lock or release. The system operates with a handle and stationary jaw in conjunction with a second pivotally secured jaw and internal adjustment bolt. A second lever handle rests against the adjustment bolt. An over center toggle link connects the second lever handle to the pivotally secured second jaw. A tension spring interconnects the first handle and the pivotally secured second jaw.

9 Claims, 6 Drawing Sheets

DUAL ACTION LOCKING PLIERS

BACKGROUND OF THE INVENTION

1. Field of the Invention

The invention relates to gripping tools, specifically pliers that are designed to be clamped firmly in place on some type of workpiece. More particularly the invention comprises a locking pliers tool featuring an improved dual action driver handle that allows the user to quickly and ergonomically squeeze the tools handle forward or rearward to respectively lock or release the tool's jaws.

2. Discussion of the Background

Articles or components are often held in place, sometimes for a long time, by pliers-type devices. A pliers-type gripping tool is considered the most favourable tool for this work, especially, if the jaw width can be made to be variable and a sure grip and release can be effected with a minimum of effort. These tools comprise a fixed handle, a movable jaw that responds to pressure squeezing on the handles. When the user wishes to grab an object such as an alligator clip, a pipe fitting, an engine part or even a barbecue fork left in the coals too long, he or she squeezes the handle and opens the jaws. Then one engages the object and twists the piston to effect a lock of the tool in place.

Normally these kind of toggle locking handle tools have a two-tonged handle, three fixed pivot points and a knurled adjusting knob that protrudes out of the end of the top most handle. One squeezes the handles together, pushes the jaws on to the workpiece, twists the handle until desired pressure is achieved and the tool is secured.

Locking pliers heretofore proposed for such use are of a single action design, opening and closing at the rear of the tool only, proving awkward to grasp and are disproportionate to the user's hand. Problems occur if the user decides to lessen the pressure temporarily or to remove the tool entirely. What one must do is reach in with both hands and twist the knurled piston follower while holding the handles. Once the tool is loosened sufficiently to disengage it then a squeezing action with one, sometimes both hands finally does free it. All this is difficult and at times impossible when the workpiece is confined or, if the pliers were attached with extreme force by strong hands and fingers. Such tools may also rely on complicated lock release mechanisms which divert the user's full grasp from the tool.

Whether it's vise grip or lock grip, these hand tools go by a variety of names and they let the user perform a wide range of jobs around the home, workshop, construction project etc. One sees them employed in clamping applications, welding applications, grinding tasks or in simple recreational activities. When the user cannot hold larger, more awkward shapes' he resorts to this type of curved jaw, force multiplying tool. It will lock and release instantly.

With so much demand for these tools inventors have attempted to solve the problems of a tension releasing and applying hand tool. The following patented references show various solutions to the challenge of engaging a workpiece with the worker's own minimal use of force, attaching and releasing successfully all with the tight confines of a workspace typically no larger than an engine compartment, a crawlspace beneath a shed or around the pipes under a kitchen sink.

U.S. Pat. No. 5,056,385 to Peterson teaches a five point pivot toggle-locking hand tool mechanism with a compound toggle linkage action. Peterson purports to have invented a tool which gives the user a mechanical advantage and a force multiplying four point power line.

U.S. Pat. No. 5,460,065 to Balmer teaches a toggle mechanism between the operating handles which allow for a camming action as the user opens or closes the handles and varies the points of contact of the jaws on the workpiece. Such a tool still only gives a craftsperson an inexact jaw lock position based on his or her ability to manipulate the compound link as the camming surfaces slide around a circular bore. This adjusting process is potentially endless and not convenient when the user cannot see what he or she is doing or cannot actually estimate the size of the workpiece itself.

U.S. Pat. No. 2,838,973 to Peterson shows a complex locking wrench device. For a user to operate this system, they must master a tension spring, web, a hook, a handle and an actuating lever cum web. Peterson does provide force multiplying pressure on the gripping jaws, but the tool is complicated to operate and not recommended for novices.

U.S. Pat. No. 3,354,759 is simply described by inventor Cook as vise grip pliers. Cook provides a button on the top handle in place of the traditional knurled edge screw treaded locking piston that normally put pressure on the jaws when the object is to be clamped. The Cook reference surpasses the other locking wrench inventions for complexity. So many levers must be simultaneously pressed, and levers engaged as that top button is pushed that the tool cannot be termed convenient.

U.S. Pat. No. 6,626,070 to Peperkorn features a quick release toggle locking mechanism. This compound toggle link controls the degree to which the tool can open. Opening the tool to obtain the so-called "snap" feel reveals a problem. This invention does not solve the problems a user encounters in trying to open and close the tool within a confined space and at the same time not dropping the pliers as he relaxes his grip to flick the handle open or clamp the jaws closed.

Wooster, U.S. Pat. No. 6,012,361 discloses a lockable pliers wrench. To operate the Wooster wrench one rotates a knurled screw to open or close the conventional jaws. This is known but Wooster's release lever is nested within the upper handle and the user closes the jaws with almost a cocking movement of the link into an over-center position. Wooster uses a release lever in the lower handle to open the jaws. This is inconvenient in that one has to move a hand from what was a secure grip to the end of the lower handle where the release lever is located. Wooster provides no provision for quick locking/unlocking of the jaws. Further, this set of pliers device can't be operated at will with a sure one-grip motion.

OBJECTS AND ADVANTAGES OF THE INVENTION

It is an object of the present invention to provide a quick lock and release mechanism for lockgrip pliers. From the previous discussion it can be appreciated that adjustment of such tools is difficult when the spaces are confining or one's hand strength or dexterity is limited. The instant invention features an improved dual action lever handle. This form of handle allows the user to quickly and ergonomically squeeze the tool handles forward or rearward in an action suggestive of a rocker switch. A user never has to relax his or her grip on the handle to lock or release the tool jaws. With this rocking motion in mind, the first handle with a stationary jaw supports a second pivotal handle and a pivotal jaw. The pivotal handle and jaw are interconnected by a toggle link. An adjustment bolt positioned within the first handle supports the second handle in the desired adjustment around the assembly. A tension spring fastened to the first handle is connected to the pivotal jaw, with an interior spring loading the locking pliers.

It is another object of the present invention to enable the user to rock the handle forward and backward in his or her grasp. What this does is facilitate the opposing functions of locking and unlocking the tool jaws. Pliers are instruments that convert a gripping pressure. They amplify the force of the hand's grip on a workpiece. If the grasp on the pliers is relaxed, the grip is lost. The instant invention prevents this loss of grip from happening. Unlike other locking pliers, the lever handle is squeezed together in clamping the tool jaws together. The result is greater ergonomic alignment of the user's hand. This ergonomic alignment creates more control and power in the clamping process. When the tool is in the clamped position, the inventive "dual action locking pliers" can be unclamped with a simple squeeze on the rear portion of the opposing handles while maintaining the desired, full power grip on the tool handles. The same efficiency of use of the instant invention is possible event with the same dual action configuration and longer handles or adjustment bolt. This is not possible with other, known locking or vise grip pliers. The invention is also more durable and less complicated to manufacture as it uses fewer parts than other pliers of the prior art.

It is also an object of this invention to provide a vise grip pliers wherein the locking cycle relies upon a simple two-pivot operation. A dimple-nosed link catches on a threaded screw. This link will alternately lodge on the other side of the handle as the jaws open to their widest bite radius. The advantage in having this in a tool is simplicity of operation, fewer parts and reliance upon positive pivot stops against purposefully designed metal surfaces. Utilizing this tool to do a job of work in a confined space such as changing the ball cock in a toilet tank the user can count on maximum grip pressure without worrying that moisture will impede the operation of the pliers' force multiplying mechanism. Within the configuration of my invention it is also possible to create the tool in extended lengths without the need to increase the length of the lever handle or adjustment bolt, which is not possible with other locking pliers configurations.

Another object of the dual action locking pliers is to provide an object gripping tool operated in part by turning an adjusting screw located in the rear of the upper stationary handle. This adjusting screw compliments the rocking handle locking/unlocking action. Whereas with other vise grip tools this adjustment screw can limit the tool's usefulness in confined situations as it extends in or out the back of the stationary handle. The dual action pliers of the instant invention has been specifically designed not to present that inconvenience to the user. With other locking vise grip pliers either the size adjusting screw has to move outward in operation or the co-operable bottom handle must expand somehow. Other patented tools utilize a release lever mounted inside or along the length of the bottom handle. The instant invention incorporates a simple, rocking and toggle mechanism. In this case the bottom handle of the dual locking vise grip pliers is more compact, especially when the jaws are accommodating a an object of large or irregular size or shape.

SUMMARY OF INVENTION

The inventive tool fits into the category of lever wrench pliers. These pliers use a dual action lever. The dual action locking pliers of the instant invention can be used in confined spaces: on bolts, pipes, etc. This tool can be locked or released by means of a one handed action on the front or back of the inventive lower handle. As with other locking pliers in the fastening tool family the instant invention has serrated jaws and a threaded tension bolt to hold the jaws open in a snug, secure fit around a part large or small. As has always been observed with any gripping tools, not just vise grip pliers, jaws work best when these jaws close with the workpiece in their grasp. The instant invention conquers this problem successfully with a powerful jaw and screw combination complemented by the uniquely designed rocking handle and toggle combination.

The present locking pliers comprises essentially two interacting handles and two interacting jaws. A first handle with a stationary jaw supports a second pivotal handle and second pivotal jaw. The pivotal handle and jaw are interconnected by a toggle link. An adjustment bolt positioned within the first handle supports the second handle at a desired adjustment. A tension spring fastened to the first handle is connected to the pivotal jaw, therein spring loading the locking pliers.

The invention will be better understood and additional features and advantages will become apparent from the following description of the preferred embodiments illustrated in the accompanying drawings. Various changes may be made in the details and arrangement of parts and certain features may be used without others. All such modifications within the scope of the appended claims are included in the invention.

DETAILED DESCRIPTION OF THE INVENTION

Figure 1:
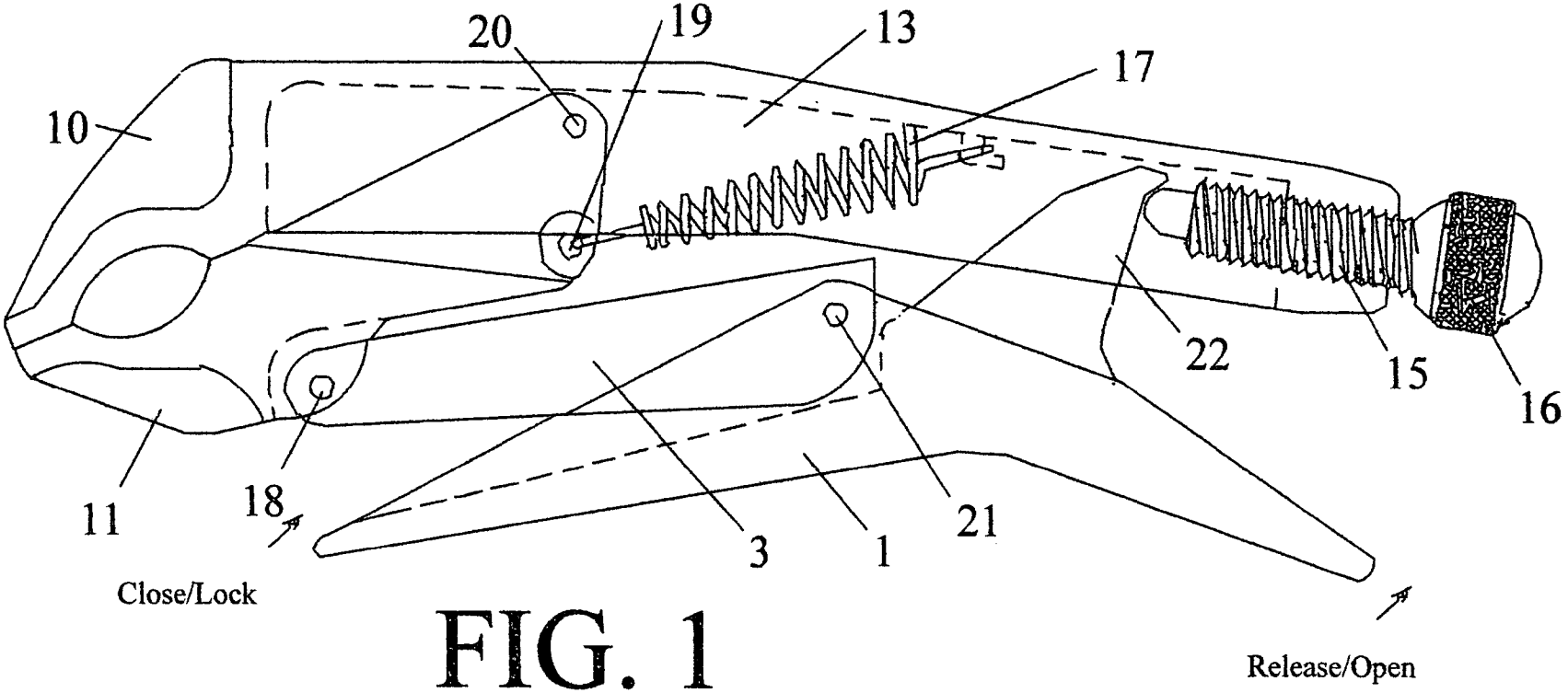
FIG. 1 is a side view of the tool according to a preferred embodiment of the invention showing the pliers' jaws meeting each other and the rocker style lower grip in a neutral position.

As shown in FIG. 1, tool 2 includes a fixed handle 13 extending out to a stationary jaw 10 on the end and a threaded adjustment screw 15 at the opposing end. This adjustment screw fits inside a threaded aperture 14 and is conveniently gripped by the knurled end 16. The inventive vise grip pliers use a movable lower jaw 11 connected to the fixed handle 13 at pivot 19 and effectively are governed as a gripping mechanism by pivot 18 and toggle 3. Toggle 3 rests against and is pivotally operated in conjunction with rocking handle 1 and pivot 21. Lower jaw 11, toggle 3 and rocking handle 1 form the grip and allow a user to lock the inventive tool to a workpiece.

Figure 2:
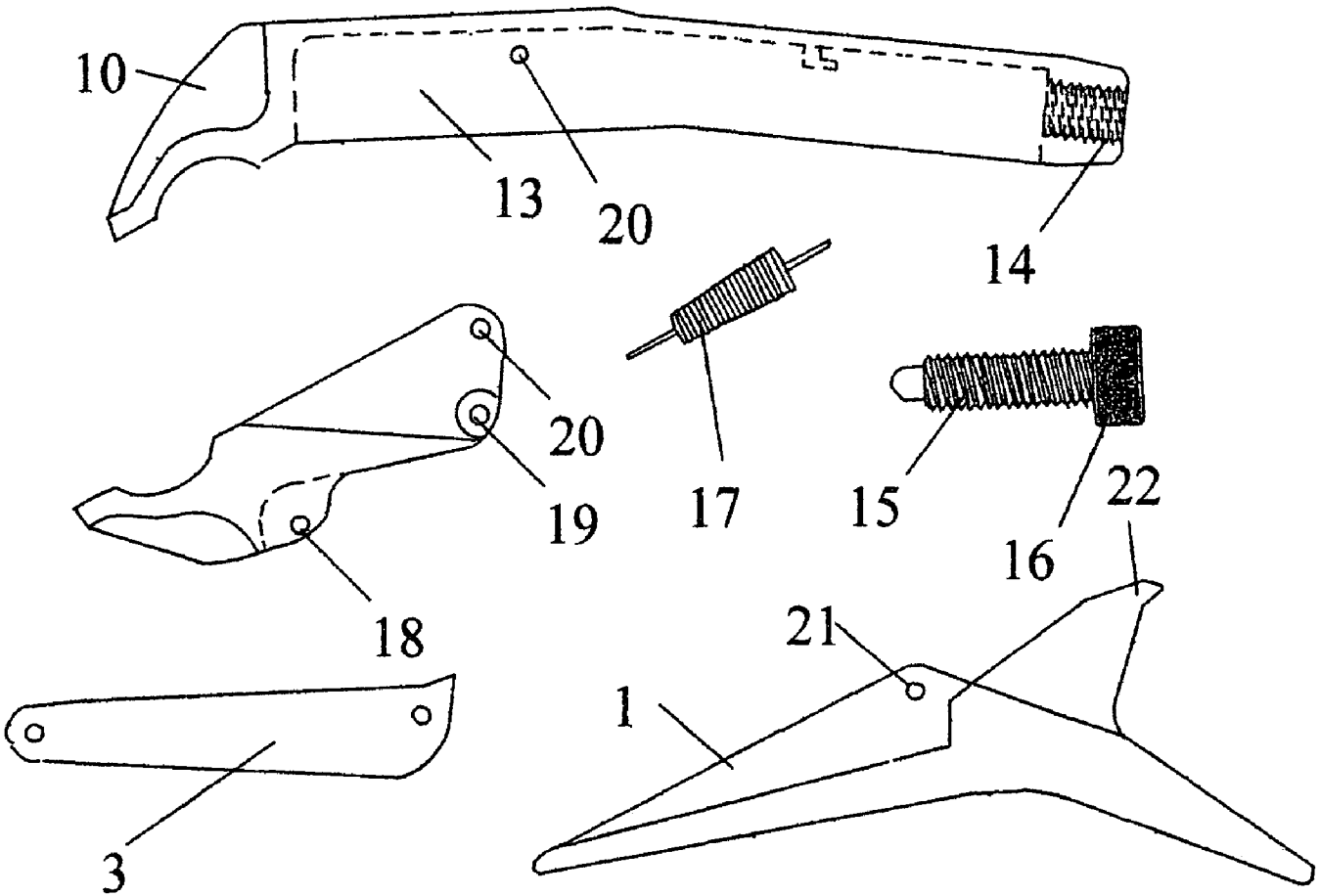
FIG. 2 is an exploded view.

FIG. 2 shows an exploded view of the instant invention showing stationary jaw 10, lower movable jaw 11, fixed handle 13, jaw adjustment screw 15, adjustment screw aperture 14, movable jaw tensioning spring 17, toggle 3, rocking handle 1, dimple nosed link 22, and four pivots 18, 19, 20, 21. From this view the parts of the dual action locking pliers can be seen as follows: stationary jaw 10, lower movable jaw 11, fixed handle 13, jaw adjustment screw 15, threaded to fit into adjustment aperture 14. Within the body of the fixed handle 13 but shown in FIG. 2 in exploded assembly is the movable jaw tensioning spring 17. In an actual application as a gripping tool, rocking handle 1 operates in concert with toggle 3 and movable jaw 11 to allow a user to exert gripping pressure. Conversely, when unlocking the dual action locking pliers, if only temporarily to gain a more advantageous hold on a workpiece, these same components will release a grip on the workpiece but the user never releases his or her grip on the tool handle itself. Upper member 22 of movable handle 1 is characterized as "dimple nosed link" designed to make a secure engagement in the interior end of the jaw adjustment screw 15. As a user puts the inventive dual action locking pliers to work in set and release situations on pipes, nuts, clamps etc., force is transmitted through pivot points 18, 19, 20 and 21.

Figure 3:
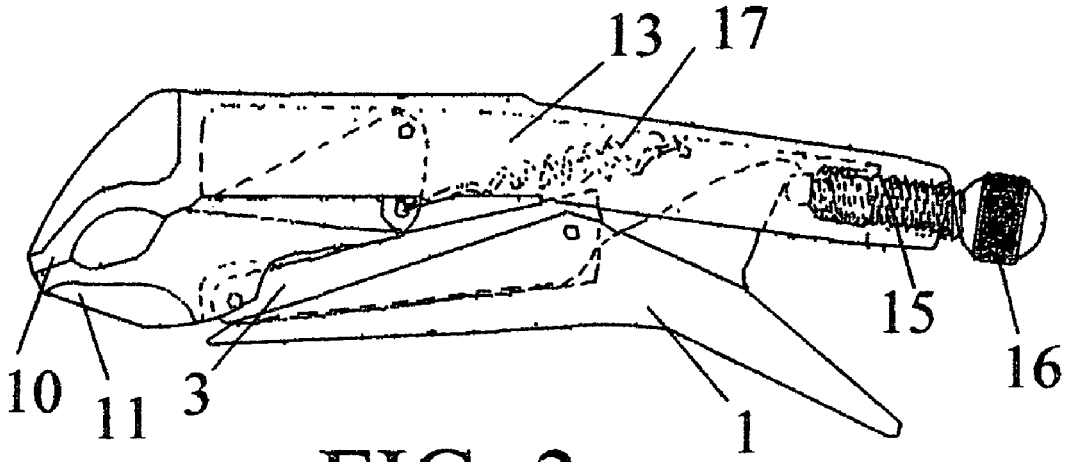
FIG. 3 is a side view of a preferred embodiment of the vise grip pliers of the instant invention in a fully closed position.
Figure 4:
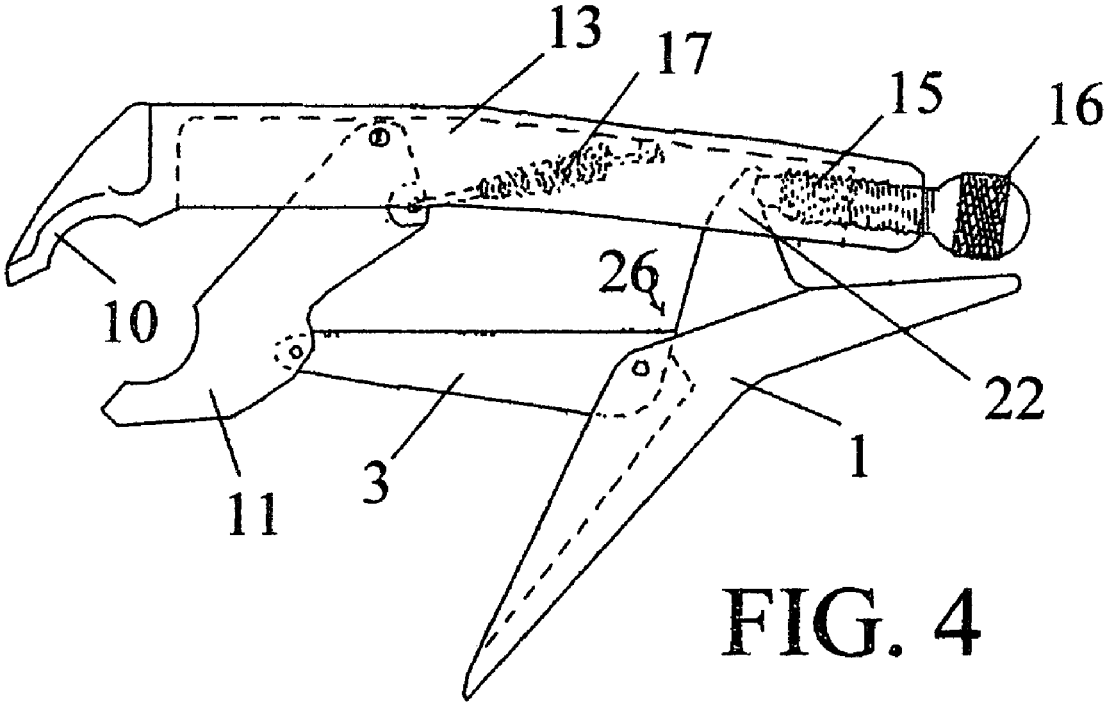
FIG. 4 is a separate side view of the inventive tool in a jaws open position. This view shows the link catching the threaded screw, the lower rocker style handle open to a full range of extension with toggle fixed and lodged against the lowest pivot.

Referring to FIG. 3, a side elevational view of the preferred embodiment of the inventive pliers, the tool 2 is shown in a fully closed position. Stationary jaw 10 and lower jaw 11 touch, as is typical with a pair of pliers. An observer can see that the nose and jaw shape are advantageously designed for gripping peculiar objects. The inventive rocking handle 1 streamlines itself with the jaws 10 and 11 in this closed position. With this streamlined tool a plumber or carpenter, for example, can reach into confined spaces where maneuverability is at a premium. Conversely the movable and stationary jaws 10 and 11 are shown in the fully open position in FIG. 4. The portion of the rocking handle 1 is pivotally aligned with the end of the jaw adjustment screw 15. At the same time the opposite end of the handle 1 protrudes downward and away from the fixed handle 13 or the main body of the tool. Note that the mm end of the toggle 3 is curved to cooperate with step 26.

Figure 5:
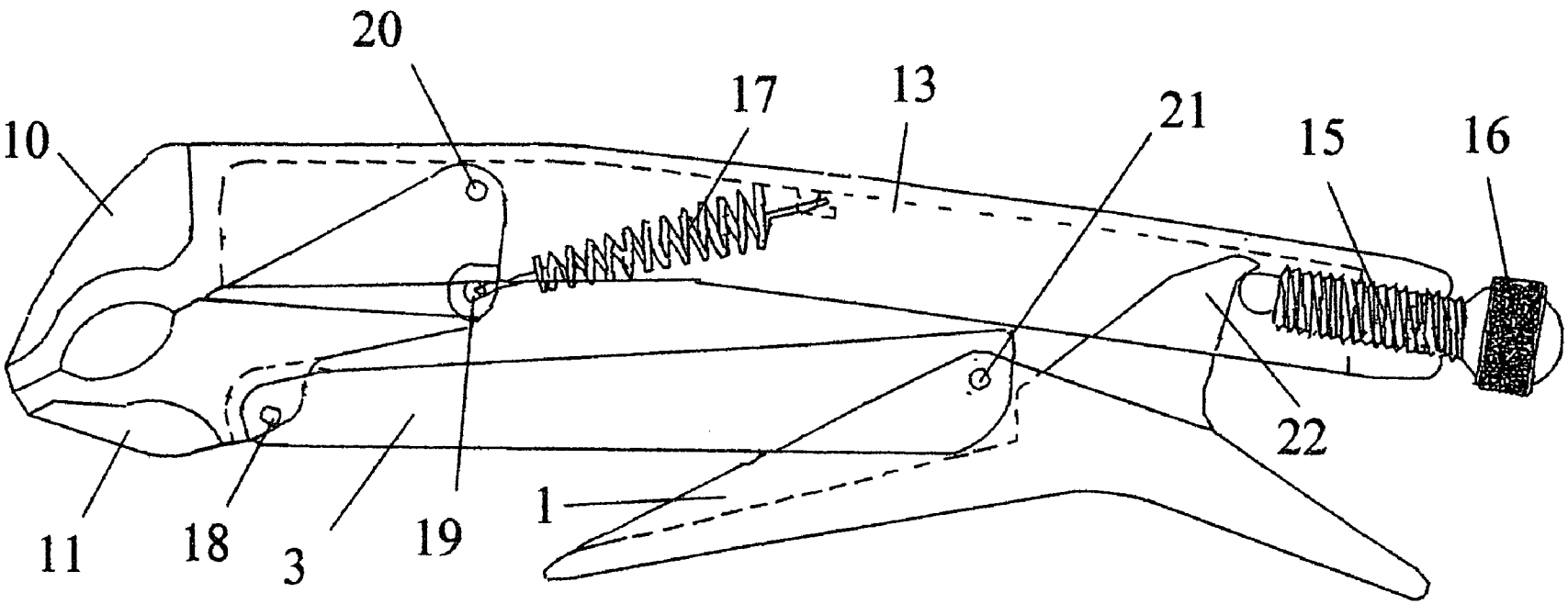
FIG. 5. is a side view of the vise grip pliers built into an extended length configuration. The tool appears in a closed position with jaws touching though not around a workpiece.

In addition, FIG. 5 shows an alternative embodiment of the dual action vise grip pliers having an extended length. The handle 1 in this drawing is operatively connected to a longer toggle 3. Jaw pressure is not compromised and neither is bite range, but the longer top handle 13 affords the user a deeper reach into a cramped workspace. In the embodiment of FIG. 5 the advantageously designed cam and rachet mechanism of the toggle 3, handle 1 and adjustment screw 15 will deliver an enormous squeezing pressure where the jaws 10 and 11 contact a workpiece.

In operation a workpiece (not shown) is engaged with jaws 10, 11. The characteristic and novel boomerang shaped handle 1 is manipulated by hand pressure on the forward part of the handle. This action tightens the gripping pressure. The user then turns the adjuster knob 16 counter clockwise until the handles close. Care should be exercised not to damage the workpiece with excessive force.

The action previously described tightens gripping pressure. At this time the toggle 3, which is pivot mounted on lower jaw 11 at a first point 18 and mounted on the moving handle 1 at a second pivot point 21, transmits gripping pressure from jaws 10 and 11 through the toggle 3 itself to the far upper end of the movable handle 1. A projection or dimple nosed link 22 reliably engages the adjustment screw 15 at the rear end. This is ordinarily hidden inside the body of the upper handle 13.

Gripping is only part of the operation. If the work is too wide to allow the tool to lock on, then pressure must be kept on the handles. The adjuster screw is then turned counter clockwise again. If the user wishes to release the tool, he or she can avail himself or herself of the unique dual action handle. This inventive feature comes to the fore when, without letting go of the tool itself, the user exerts hand pressure of the gently curving handle 1. At once the toggle stop at the pivot point 21 slides away from its niche on the movable handle 1 and the jaws relax their grip. The user can then turn the adjuster 16 clockwise a small number of turns, if necessary, to get a better grip on the work.

Figure 6:
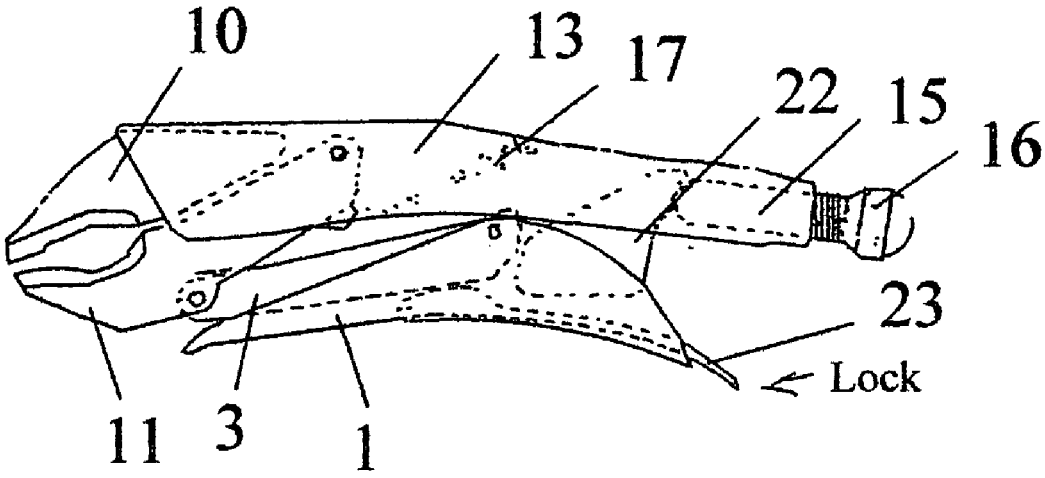
FIG. 6. is a side view of an alternative embodiment of the inventive grip pliers showing a lock release trigger on the inside of the lower movable handle and extending out the end of the handle. The tool is closed in this view.
Figure 7:
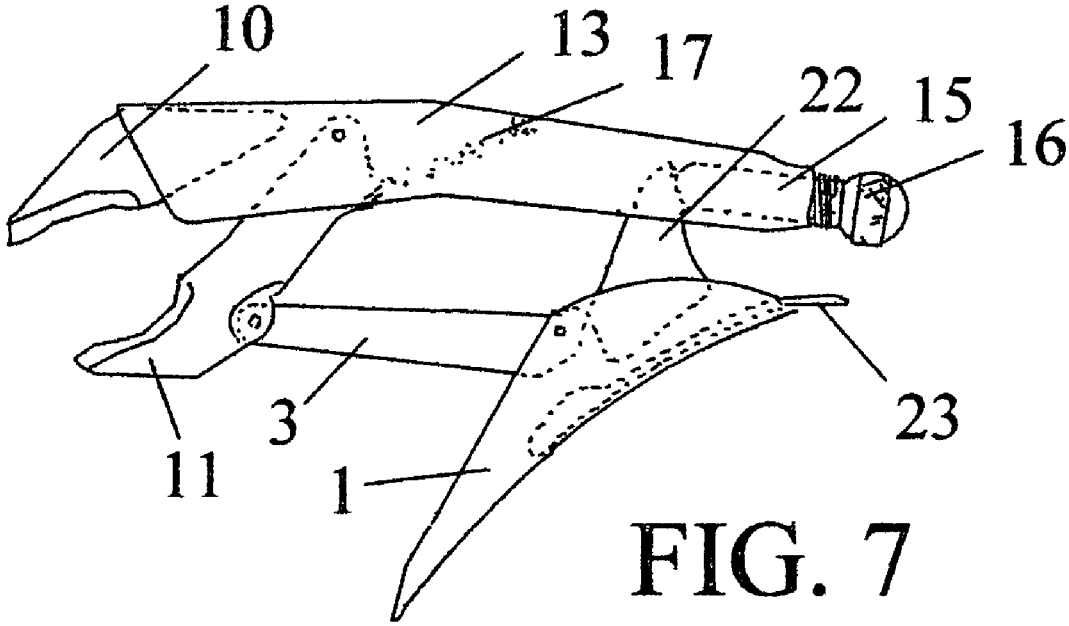
FIG. 7. is a side elevational view of an alternative embodiment of the vise grip pliers equipped with lock release trigger. The pliers appear with the jaws open.
Figure 8:
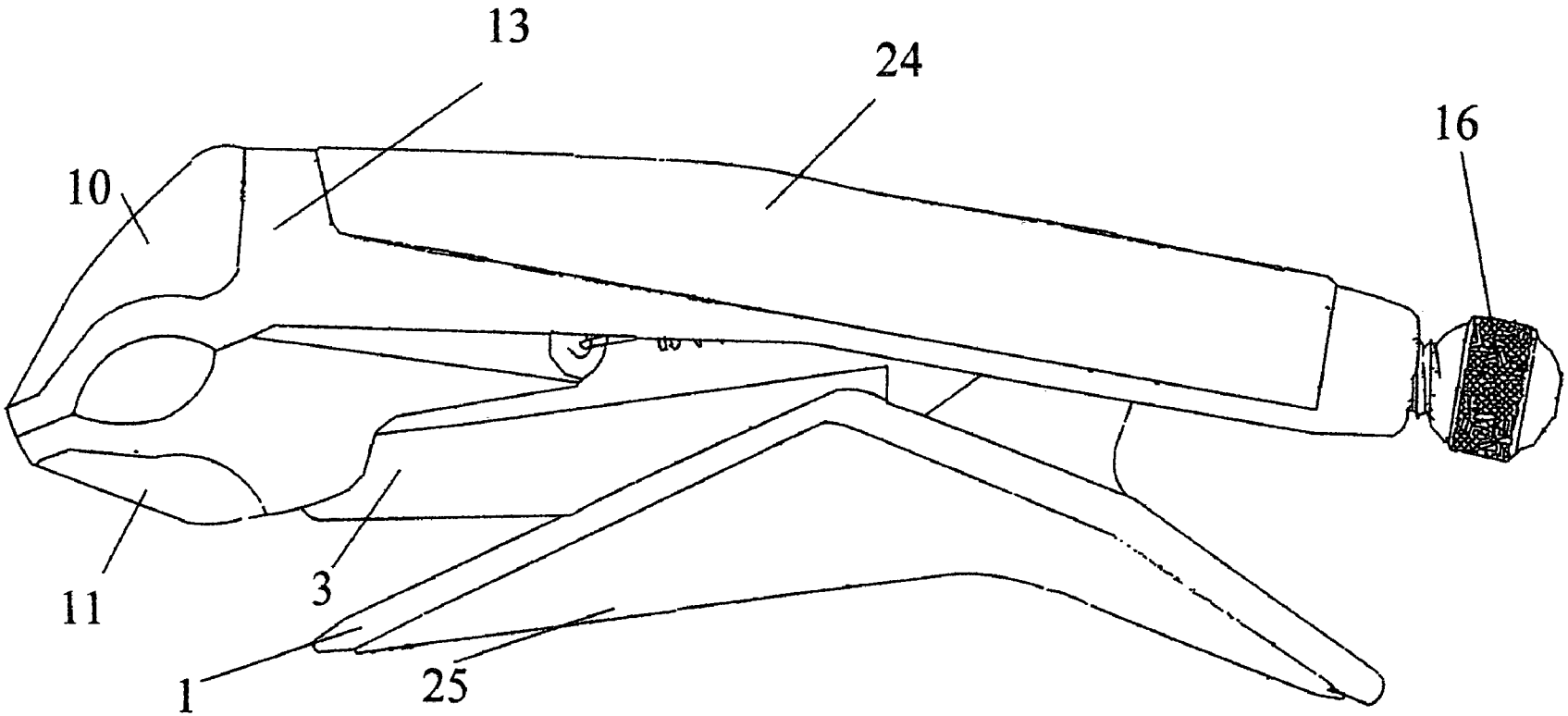
FIG. 8. is a side view of the locking pliers featuring an alternative resilient grip across the bottom of the novel movable handle.

An alternate embodiment of the tool is shown in FIG. 6 in a closed position and in FIG. 7 in a open position, additionally provided with a lock release trigger 23. The pliers can be released by holding the handles 1 and 13 firmly in one hand and pulling the lock release trigger 23 with the other hand. The spring inside the upper handle governs toggle and jaw movement but the toggle, pivot points and handle provide most of the tool's flexible application of pressure. FIG. 8 shows a further alternative embodiment of the invention provided with resilient grips 24 and 25. These may be made of any suitable material, such as rubber or the like.

As will readily be appreciated by those skilled in the art, numerous modifications and variations of the above embodiments of the present invention are possible without departing from the scope of the invention. It is intended that all matter contained shall be interpreted as illustrative and not in a limiting sense.

What is claimed is:

1. A plier type toggle locking hand tool comprising:

a fixed handle with a first end and a second end;

a first jaw at said first end of said fixed handle;

a second jaw pivotally attached to said fixed handle and configured to cooperate with said first jaw;

a toggle link having a first end and a second end, said first end of said toggle link pivotally attached to said second jaw;

a movable handle having a first end, a second end and a pivot point therebetween, said pivot point pivotally attached to said second end of said toggle link; and an adjuster attached to said second end of said fixed handle and configured to adjustably abut said movable handle.

2. The hand tool claimed in claim 1 wherein;

said first and second ends of said movable handle form an obtuse angle with said pivot point.

3. The hand tool as claimed in claim 2 wherein:

a projection is further provided at said second end of said movable handle, said projection configured to abut said adjuster.

4. A hand tool as claimed in claim 3 wherein:

said projection is provided with a step on a side opposing said adjuster; and said second end of said toggle has a curved shape configured to cooperate with said step.

5. The hand tool claimed in claim 3, further comprising:

a resilient trigger provided at said second end of said movable handle and configured to release said movable handle when said trigger is depressed.

6. The hand tool claimed in claim 1 further comprising:

a spring attached to said second jaw and to said fixed handle.

7. The hand tool as claimed in claim 1 wherein:

said adjusting means comprises a threaded aperture in said second end of said fixed handle; and a screw engaged in said threaded aperture.

8. The hand tool as claimed in claim 7, wherein:

said screw is provided with a head; and said head comprises a knurled cylindrical surface at a rotational circumference thereof.

9. The hand tool as claimed in claim 1, further comprising:

a resilient outer surface over at least one of said fixed handle and said movable handle.

* * * * *